US005531309A

United States Patent [19]

Kloss et al.

[11] Patent Number: 5,531,309

[45] Date of Patent: Jul. 2, 1996

[54] METHOD AND APPARATUS FOR DETECTING FRAUD OR THEFT IN A GAMING MACHINE

[75] Inventors: Hans G. Kloss, Berlin, Germany; Raymond J. Heidel, Henderson, Nev.

[73] Assignee: Bally Gaming International, Inc., Las Vegas, Nev.

[21] Appl. No.: 520,215

[22] Filed: Aug. 28, 1995

[51] Int. Cl.[6] ..... G07F 17/34

[52] U.S. Cl. ..... 194/202; 340/825.32

[58] Field of Search ..... 194/200, 202, 194/339; 177/25.17, 200; 340/825.32; 364/412

[56] References Cited

U.S. PATENT DOCUMENTS

| | | | |
|---|---|---|---|
| 3,552,511 | 1/1971 | Marcheso et al. | 177/1 |
| 3,998,309 | 12/1976 | Mandas et al. . | |
| 4,190,066 | 2/1980 | Burnside | 133/4 R |
| 4,238,127 | 12/1980 | Lucero et al. | 273/138 A X |
| 4,243,133 | 1/1981 | Nicolaus . | |
| 4,247,019 | 1/1981 | Lerner | 222/77 X |
| 4,257,512 | 3/1981 | Hooker . | |
| 4,375,243 | 3/1983 | Doll | 177/25 |
| 4,493,384 | 1/1985 | Yano et al. | 177/25 |
| 4,512,428 | 4/1985 | Bullivant | 177/25 |
| 4,646,767 | 3/1987 | Hikita | 177/50 |
| 4,674,060 | 6/1987 | Larkin et al. | 364/567 |
| 4,795,155 | 1/1989 | Grande | 273/143 R |
| 5,067,604 | 11/1991 | Metcalf | 194/203 |
| 5,193,629 | 3/1993 | Lare | 177/25.17 |
| 5,199,517 | 4/1993 | Kirby | 177/25.17 |
| 5,429,361 | 7/1995 | Raven et al. | 273/138 A |

FOREIGN PATENT DOCUMENTS

| | | | |
|---|---|---|---|
| 0090894 | 10/1983 | European Pat. Off. . | |
| 549249 | 6/1993 | European Pat. Off. | 194/202 |
| 4015852 | 11/1991 | Germany . | |
| 2027914 | 2/1980 | United Kingdom . | |
| 2124003 | 2/1984 | United Kingdom | 194/202 |

*Primary Examiner*—F. J. Bartuska
*Attorney, Agent, or Firm*—Jenner & Block

[57] ABSTRACT

A gaming machine has internal coin container sensors (110, 112) that sense the weight, and therefore, the number of coins contained in the internal coin containers (104, 106). The gaming machine also has mechanical and/or optical sensors (102, 114) to monitor the inflow and outflow of coins. By comparing the number of coins, as determined by weight, with the number of coins detected by the mechanical and/or optical sensors, fraud is readily detected.

20 Claims, 4 Drawing Sheets

METHOD AND APPARATUS FOR DETECTING FRAUD OR THEFT IN A GAMING MACHINE

BACKGROUND OF THE INVENTION

1. Field of the Invention

This invention relates generally to the field of gaming machines, and in particular, to a method and apparatus that detects fraud or theft in a coin-operated gaming machine by monitoring the weight, and therefore the number, of coins contained in and removed from the gaming machine.

2. Description of the Prior Art

Gaming machines such as slot machines are traditionally activated by a player inserting one or more coins or tokens into the gaming machine. If the player wins, coins or tokens may be paid out to the player. Recently, gaming machines have been modified to accept in addition to coins, paper currency, credit cards and bar coded credits. Though very popular, these alternate forms of currency have not eliminated the use of coins and tokens.

Generally, gaming machines that receive and dispense coins are provided with a coin drop box and a payout hopper. When coins are inserted into the gaming device, they are directed to either the coin drop box or the payout hopper. As the name suggests, the payout hopper holds coins that will be dispensed to the player if the player obtains a winning selection. The coin drop box holds excess coins that will be collected by the gaming machine operator. U.S. Pat. No. 4,238,127 issued to Lucero et al. discloses a gaming machine that senses the weight of the payout hopper and when the weight attains a certain threshold, coins inserted into the gaming machine are diverted to the coin drop box. This gaming machine allows the payout hopper to stay sufficiently full but prevents overflow of the payout hopper by diverting coins to the coin drop box.

As there is a constant inflow and outflow of coins through a gaming machine, it is extremely important to keep precise and accurate records of game activity. The gaming machine must accurately monitor the number of coins inserted into the gaming machine and must accurately payout the correct amount of coins won by the player. Accurate accounting is not only required for the gaming machine operator, but is also required by gaming regulations.

Standard techniques are used for automatically counting the number of coins inserted into a gaming machine and counting the number of coins paid out of the gaming machine. Two such techniques include using a mechanical trip device and an optical sensor device. Both devices essentially count the passing of coins either into the gaming machine or out of the gaming machine. Unfortunately, both the mechanical trip devices and the optical sensors are susceptible to fraud.

A technique of fraud commonly known as "stringing" can thwart mechanical trip devices. The technique of stringing and a device designed to overcome this fraud are described in U.S. Pat. No. 4,243,133 issued to Nicolaus. Stringing is accomplished by attaching a string to the coin inserted in the gaming machine and manipulating the coin with the string to make it appear that several coins were inserted.

Optical sensors were implemented to overcome fraud by stringing. An example of an optical sensing device is described in U.S. Pat. No. 3,998,309 issued to Mandas et al. The optical sensors, however, are also susceptible to fraud, especially at the point of payout. Optical sensors transmit a beam of light across a path along which coins may pass from a payout hopper to a payout receptacle. An interruption in the beam of light represents the passage of a coin. By placing a light emitting device in a position near the optical sensor, the operation of the sensor is interrupted such that the sensor does not detect the passage of coins, and therefore, does not signal the gaming machine to stop providing coins from the payout hopper. That is, by fraudulently manipulating the optical sensor, a player may receive a payout of the entire contents of the coin hopper. This obviously is not desirable for the gaming machine operator.

During the operation of the gaming machine, the payout hopper may become depleted and may need replenishing, or the coin drop box may become full and need emptying. In addition, the gaming machine may need to be inspected by various personnel. In these situations, the gaming machine operators' personnel need to gain access to the internal portion of the gaming machine, and in particular, may need to gain access to the payout hopper and/or coin drop box. Because both the mechanical and the optical sensing devices operate at the point of insertion and payout only, they are not useful in detecting direct bulk changes to either the coin hopper or the coin drop box. Therefore, these operations provide opportunities for employee fraud or theft.

In the fraudulent scenarios discussed above, the situation is further aggravated in that the fraud or theft may not be detected until substantially after it has occurred. Since gaming machines are generally found in abundance, such as in a casino, the perpetrator of the fraud will move from machine to machine to increase ill-gotten gains. Early detection of fraud decreases the perpetrator's chances of multiplying his gains.

Therefore, there is a need for an accurate and instantaneous system to monitor and prevent fraud in gaming machines.

SUMMARY OF THE INVENTION

It is an object of the present invention to provide instantaneous and continuous information concerning the number of coins contained in a gaming machine.

It is a further object of the present invention to enable the gaming machine operator to detect fraud by players of the gaming machine.

It is a further object of the present invention to detect and prevent fraud when the internal components of the gaming machine are accessed by gaming machine personnel.

In one embodiment of the present invention, a gaming machine is provided with a coin payout hopper and a mechanical or optical sensor for detecting the number of coins ejected from the coin payout hopper to be dispensed to a winning player. A coin hopper sensor is connected to the coin hopper for detecting the weight of the coin hopper and its contents. The weight of the coin hopper is used by a computer to determine the number of coins contained in the hopper. The computer also monitors the number of coins sensed by the mechanical or optical sensor, thereby determining a number of coins ejected from the coin hopper to a player. To detect fraud by a player of the gaming machine, the computer continuously compares the number of coins in the hopper, as determined by the weight, with the number of coins dispensed from the hopper, as determined by the mechanical or optical sensor. A discrepancy in the number of coins in the hopper and the number of coins sensed by the sensor indicates possible fraud to the gaming machine operator.

In another embodiment of the present invention, the gaming machine includes a switch that detects entry into the interior of the gaming machine and also exit out of, or resecuring of, the gaming machine internals. The weight of the coin payout hopper, as determined by the coin hopper sensor, is recorded upon the detection of entry into the gaming machine. When the gaming machine internals are exited, and the gaming machine internals are resecured, the weight of the coin hopper, as determined by the coin hopper sensor, is again recorded. The computer may compare the weight of the coin hopper prior to entry with the weight of the coin hopper after exit to determine if there was a net change. An expected change in the number of coins in the coin hopper may be registered in the computer by the gaming machine operator. By comparing the weight of the coin hopper prior to entry, the weight of the coin hopper after exit, and any expected net change amount, the computer may determine if there was a discrepancy indicting the possibility of fraud or theft.

In yet another aspect of the invention, a drop box sensor is also provided for continuously determining the weight, and therefore the number of coins, in the coin drop box. The weight of the drop box, as determined by the drop box sensor, is recorded upon entry into and exit out of the gaming machine, in a manner similar to that employed with the coin payout hopper. The weight of the drop box prior to entry into the gaming machine and the weight of the drop box after exit out of the interior of the gaming machine are used to determine whether fraud or theft occurred during maintenance of the internals of the gaming machine.

In another aspect of the present invention, each valid coin inserted into the gaming machine is detected. The total number of valid coins detected is accumulated. Any coin containers housed in the gaming machine, such as the coin drop box and coin payout hopper, are continuously sensed, providing a weight for the coin containers. The weight of the coin containers is converted into a number of coins based on the weight of each coin. The total number of valid coins detected is reduced by the number of coins either ejected from the coin payout hopper or removed from the coin drop box. By comparing the number of coins determined by weight with the total number of coins inserted, detected, ejected or removed from the gaming machine, an indication of fraud or theft is obtained.

DETAILED DESCRIPTION OF THE PREFERRED EMBODIMENTS

Figure 1:
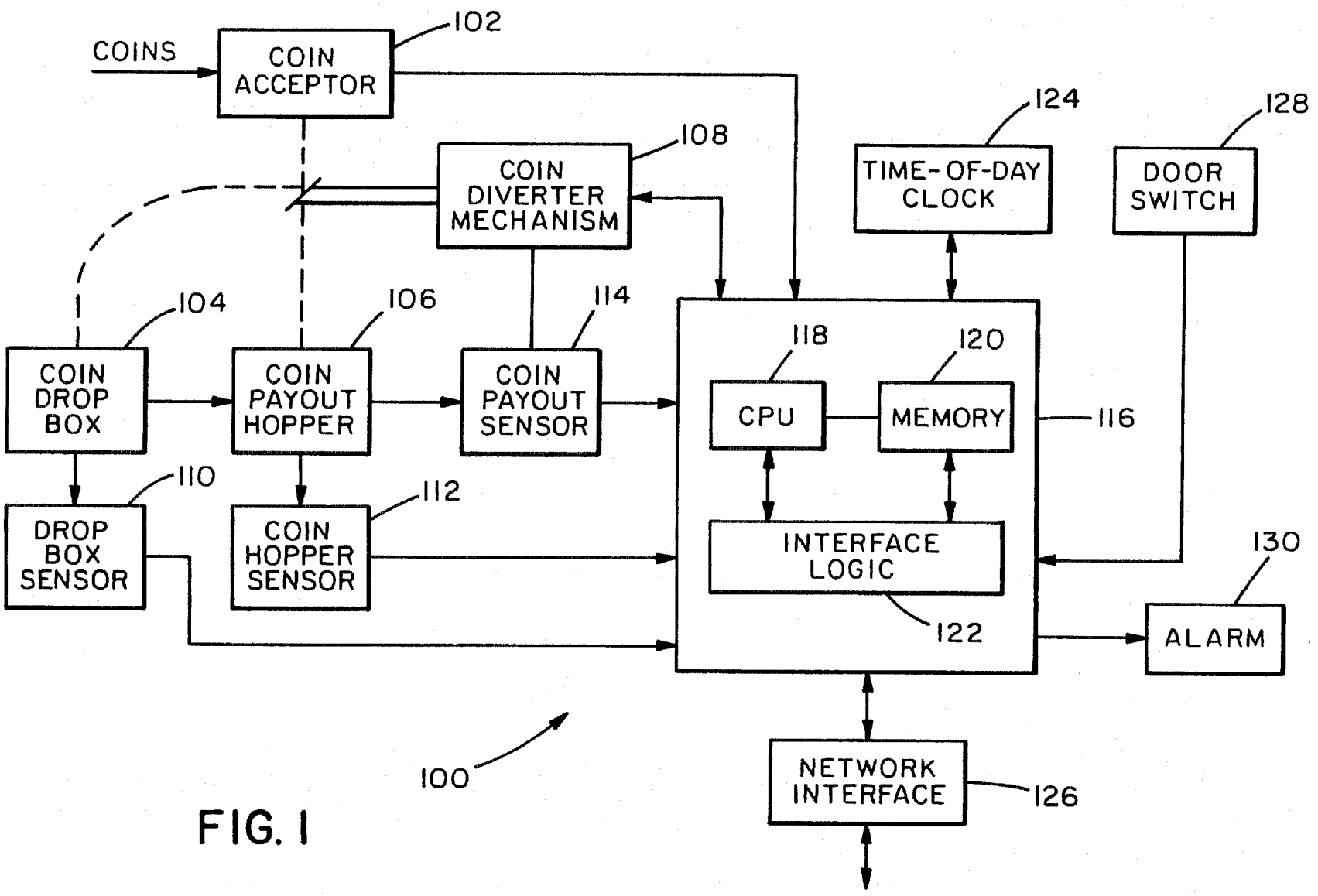
FIG. 1 is a block diagram of a preferred embodiment of a gaming machine in accordance with the principles of the present invention.

FIG. 1 is a block diagram of a gaming machine 100 in accordance with the principles of the present invention. The gaming machine 100 has a coin acceptor 102, which accepts valid coins placed into gaming machine 100 by a player. A coin drop box 104 and a coin payout hopper 106 are provided to receive the coins accepted by the coin acceptor 102. A coin diverter mechanism 108 directs the coins either to coin drop box 104 or coin payout hopper 106, depending on the fullness of each. A drop box sensor 110 and a coin hopper sensor 112 are operably connected, respectively, to coin drop box 104 and coin payout hopper 106 for sensing the weight, including the contents, of each. A coin payout sensor 114 detects coins ejected from coin payout hopper 106 to the player of the gaming machine. A computer 116 having a CPU 118, memory 120, and interface logic 122 is provided to monitor and control the other components of gaming machine 100. Computer 116 uses a network interface 126 to communicate with other gaming machines or computers. Additionally, a time-of-day clock 124 is provided as a time reference for computer 116. A door switch 128 alerts computer 116 to the opening and closing of the door (not shown) to the interior of gaming machine 100. An alarm 130 is provided that is activated under the control of computer 116.

Coin acceptor 102 discriminately determines whether a coin inserted in gaming machine 100 is a valid coin. Invalid coins are returned to the player and not processed by gaming machine 100. Valid coins activate gaming machine 100 and are directed to either coin drop box 104 or coin payout hopper 106. Valid coins are detected by a mechanical or optical sensor within coin acceptor 102. The mechanical or optical sensor signals computer 116 on each occurrence of a valid coin.

Coin drop box 104 is the repository for coins that will be collected by the gaming machine operator. On the other hand, coin payout hopper 106 is the repository for coins to be ejected to players obtaining winning selections or combinations. Drop box sensor 110 is a scale operably connected to coin drop box 104 to sense the weight of coin drop box 104 and its contents. Preferably, the sensitivity of drop box sensor 110 is at least +/− one coin. Drop box sensor 110 supplies the weight of coin drop box 104 to computer 116 via its interface logic 122. Interface logic 122 allows computer 116 to sense and record the weight of coin drop box 104.

Coin hopper sensor 112 is a scale operably connected to coin payout hopper 106 for sensing the weight of coin payout hopper 106 and its contents. Preferably, the sensitivity of the coin hopper sensor 112 is at least +/− one coin. Coin hopper sensor 112 supplies computer 116 with the weight of coin payout hopper 106 via interface logic 122.

Coin payout sensor 114 is connected to coin payout hopper 106 to count each coin that is ejected from coin payout hopper 106 to the player of gaming machine 100. Coin payout sensor 114 supplies a signal to computer 116 via its interface logic 122 that indicates the ejection of a coin from coin payout hopper 106. Coin payout sensor 114 may sense the ejection of a coin by either a mechanical or optical sensor.

Time-of-day clock 124 and network interface 126 are peripherals of computer 116. Time-of-day clock 124 continuously supplies a time reference to computer 116. This time reference is used to time stamp events that occur within gaming machine 100. Network interface 126 allows computer 116 to communicate with a gaming machine operator, additional computers and additional gaming machines. Network interface 126 is useful in coordinating and administrating several gaming machine apparatus.

Door switch 128 is an electro-mechanical switch that provides an electrical signal to computer 116 through its interface logic 122 that indicates the status of the door to the interior of the gaming machine 100. Housed within the interior of gaming machine 100 are coin drop box 104, drop box sensor 110, coin payout hopper 106, coin hopper sensor 112 and additional components. Access to the interior of gaming machine 100 is restricted. Preferably, door switch 128 signals computer 116 upon entry into, and exit out of, gaming machine 100.

Alarm 130 is provided to alert gaming machine personnel to problems with gaming machine 100. The alarm 130 may be a visual indication, an audible indication or both. Preferably, alarm 130 is a message transmitted via network interface 126 to a gaming machine operator or a central computer monitoring gaming machine 100.

Computer 116 is the central control for gaming machine 100. Traditional computer components including CPU 118, memory 120 and interface logic 122 provide the necessary control for gaming machine 100. In addition to the security functions described herein, computer 116 may control additional aspects of gaming machine 100, including control of game play, cashless gaming machine operations, and communication and control with other gaming machines.

Figure 2:
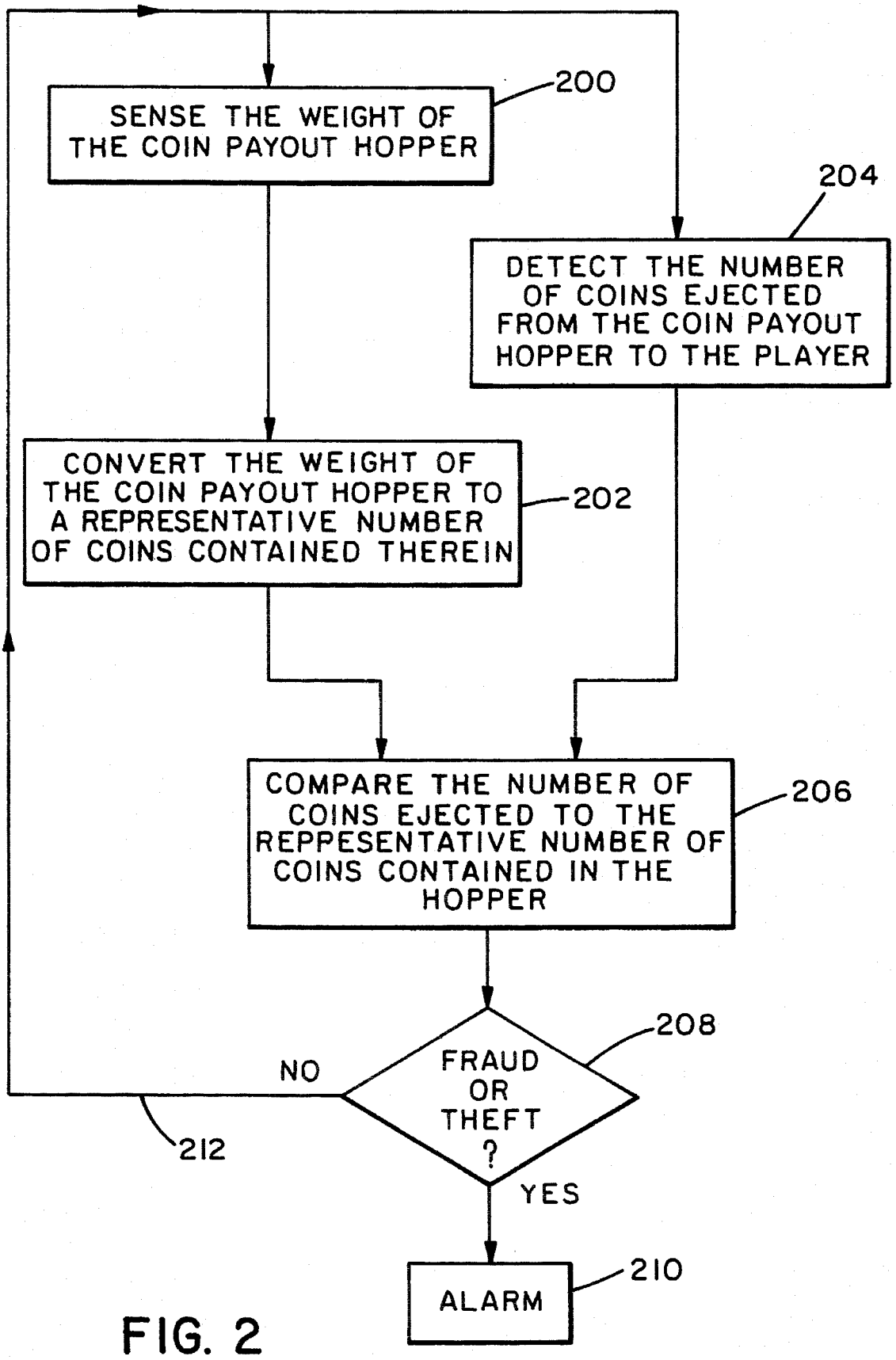
FIG. 2 is a flow diagram of a preferred embodiment of a method of detecting fraud in a gaming machine in accordance with the principles of the present invention.

FIG. 2 is a flow diagram illustrating a method of detecting fraud in a gaming machine. The flow diagram also illustrates one aspect of operation of gaming machine 100, shown in FIG. 1. The method illustrated in FIG. 2 is directed to preventing fraud or theft at the point where coins are dispensed to the player. In particular, the method detects fraud caused by interfering with the detection of coins ejected from the payout hopper. Specifically, the method detects a player who receives more than his share of winnings from the payout hopper by preventing the payout hopper from detecting the number of coins it has dispensed.

First, the weight of the coin payout hopper is sensed (200). The weight of the coin payout hopper may be sensed continuously or periodically. Alternatively, the weight of the coin payout hopper may be sensed upon the occurrence of an event that will change the weight of the hopper. For example, the weight of the coin payout hopper may be sensed each time a coin is received therein or each time a coin is ejected. Preferably, the weight of the coin payout hopper is periodically sensed and also is sensed upon the detection of any event that should cause a change in weight. In gaming machine 100, coin hopper sensor 112 continuously senses the weight of coin payout hopper 106. This weight is available to computer 116 through its interface logic 122.

The weight of the coin payout hopper reflects the number of coins it contains. By taking the total weight of the coin payout hopper, subtracting the weight of an empty coin payout hopper and dividing the difference by the weight of one coin, the approximate number of coins contained in the coin payout hopper is obtained (202). In gaming machine 100, coin hopper sensor 112 supplies the total weight of coin payout hopper 106 to computer 116. The weight of coin payout hopper 106 when empty and the weight of one coin may be supplied to computer 116 at initialization of gaming machine 100. Alternatively, the weight of coin payout hopper 106 and the weight per coin may be selected via software options in computer 116.

In parallel with sensing the weight of the coin payout hopper, the number of coins ejected from the coin payout hopper to the player is detected (204). In gaming machine 100, coin payout sensor 114 uses its mechanical or optical sensor to detect the number of coins ejected from coin payout hopper 106. A signal is supplied to computer 116 via interface logic 122 when each coin is ejected. Computer 116, under software control, accumulates the number of coins ejected. The number of coins ejected must be reset and initialized at appropriate times, such as start up or maintenance.

By tracking directly the contents of the coin payout hopper and sensing the number of coins ejected, a comparison is possible of the number of coins ejected and the number of coins in the hopper (206). If there is a discrepancy between the number of coins detected as ejected and the number of coins removed from the hopper based on weight, then there may be a fraud (208). In particular, if the number of coins detected as ejected is less than the number of coins removed from the hopper based on weight, then a player may have thwarted the mechanical or optical sensor during payout. In gaming machine 100, coin hopper sensor 112 and coin payout sensor 114 both interface to computer 116 to provide the numbers necessary to determine if there is a discrepancy in the coins ejected and the coins retained.

If fraud is detected, then an alarm may be generated (210). The alarm may be a visual indicator, an audible indicator or both. Alternatively, the alarm may be sent over a network to a central monitoring computer or gaming machine operator. If no fraud is detected (212), normal operation continues.

Figure 3:
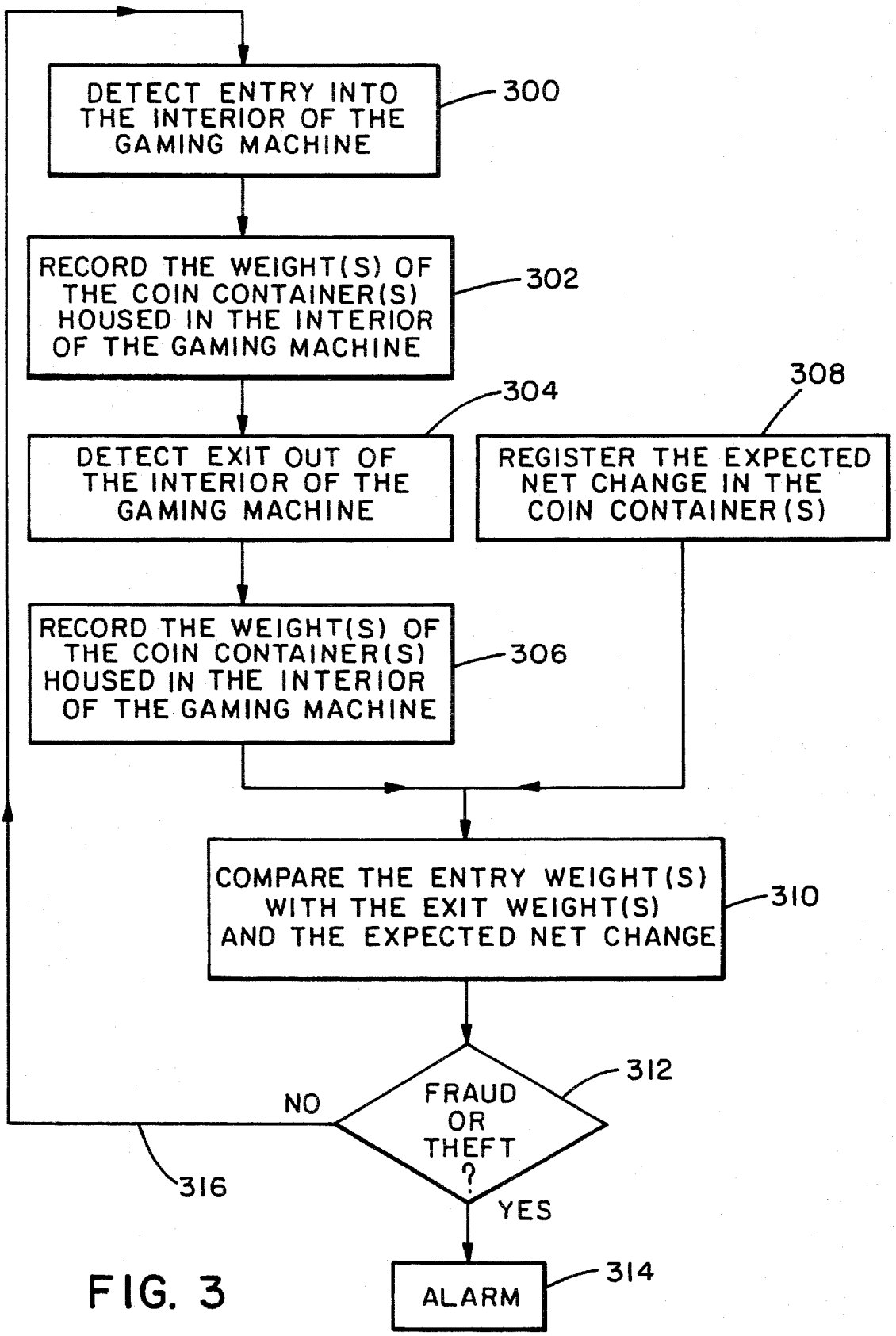
FIG. 3 is a flow diagram of another preferred embodiment of a method of detecting fraud in a gaming machine in accordance with the principles of the present invention.

FIG. 3 is a flow chart illustrating a method of detecting fraud in a gaming machine. The method also illustrates one aspect of operation of gaming machine 100, shown in FIG. 1. This method is primarily concerned with detecting fraud or theft occurring during maintenance of the interior of the gaming machine. Interior access to the gaming machine is restricted. However, interior access may be necessary for maintenance of the gaming machine or for removing or adding coins to the coin containers. In particular, the coin payout hopper 106 may need to be replenished with coins for payout or coin drop box 104 may need to be emptied.

First, entry into the interior area of the gaming machine is detected (300). In gaming machine 100, door switch 128 detects entry into the interior of the gaming machine. Door switch 128 provides this indication to computer 116.

Next, the weights of the coin containers are recorded (302). In gaming machine 100, the coin containers are coin drop box 104 and coin payout hopper 106. Drop box sensor 110 and coin hopper sensor 112 supply the weights of coin drop box 104 and coin payout hopper 106, respectively, to computer 116.

The time at which the weights of the coin containers are sensed may vary. The weights may be sensed directly after detection of entry by door switch 128. However, this may present some problems due to shock or vibration of the gaming machine at the opening of the door. Alternatively, the weights may be sensed continuously or periodically with the desired weight being saved following the detection of entry into the interior of the machine. In addition, the weights may be sensed whenever there is an expected change in the state of coin drop box 104 or coin payout hopper 106, such as the detection of a coin by coin acceptor 102 or the detection of ejection of a coin from coin payout hopper 106 by coin payout sensor 114. Preferably, the weights are sensed periodically and upon detection of an expected change with the last weight sensed prior to detecting entry into the machine being recorded. The recorded weights are stored as entry weights.

While the interior of the gaming machine is accessible, there may be changes in the contents of the coin containers. However, some maintenance may not require a change in the contents of the coin containers. If there is an expected net change in the coin containers, the change may be registered with the computer 116 (308), preferably, prior to accessing the interior of the gaming machine.

Once maintenance of the gaming machine is complete and the door is closed, exit out of the interior of the machine is detected (304). In gaming machine 100, door switch 128 detects the resecuring of the game machine door and alerts computer 116.

After the gaming machine's interior has been resecured, the weights of the coin containers are sensed and recorded (306). As discussed above, this sensing may be timed in many ways. Preferably, the weights are sensed periodically and upon the events that will result in a change in the contents of the coin containers. The weights detected upon exit will reflect any changes in the coin containers. In particular, if coins were removed or added to either coin drop box 104 or coin payout hopper 106, then the weights detected upon exit will reflect the changes. The weights obtained upon exit are recorded as the exit weights.

The entry weight and exit weight of each coin container are compared to determine an actual net change. This change reflects the difference in the weights before entry and after exit. This actual net change in weight is easily converted into a number of coins by dividing the total weight by the weight of one coin. This number may then be compared with the registered expected net change to determine if there is a discrepancy (310). If there is no registered expected change, then the entry weights and the exit weights should be the same, respectively.

A discrepancy between the actual net change and the expected net change indicates the possibility of fraud or theft (312) and an alarm (314) should be indicated. If there is no discrepancy (316), then no action is taken until the next entry into the gaming machine.

Figure 4:
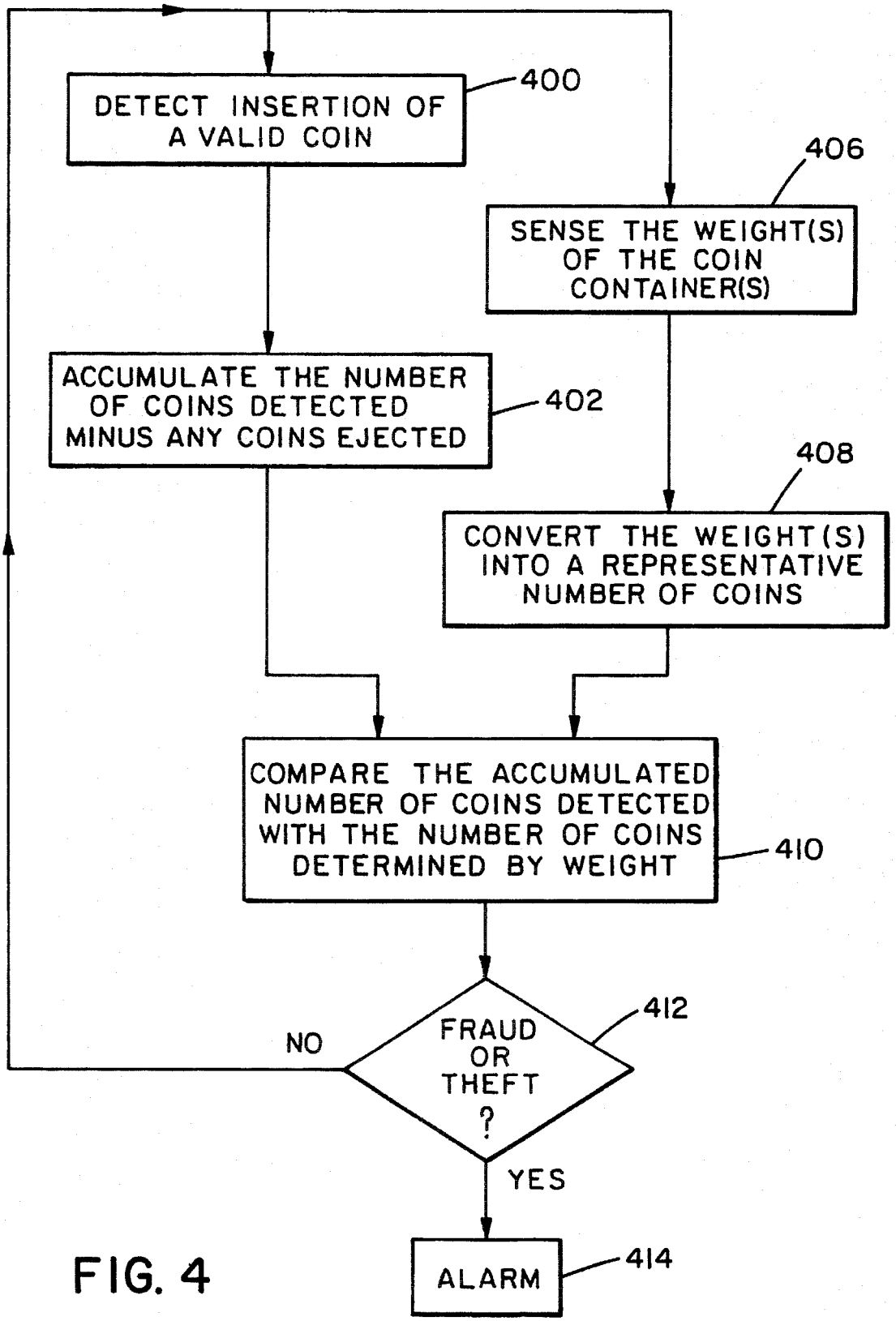
FIG. 4 is a flow diagram of an additional preferred embodiment of a method of detecting fraud in a gaming machine in accordance with the principles of the present invention.

FIG. 4 illustrates a flow chart for a method of detecting fraud in accordance with the principles of the present invention. This method also describes one aspect of operation of gaming machine 100, shown in FIG. 1. This method is primarily directed to fraud or theft that may occur at the point of insertion of coins into the gaming machine. In particular, this method detects fraud that deceives the coin acceptor into indicating a coin has been received where a coin has not.

First, insertion of a valid coin into the gaming machine is detected (400). In gaming machine 100, coin acceptor 102 detects valid coins and supplies a signal to computer 116. Notably, this detection may be the actual insertion of a coin or may be the result of fraud.

The number of coins detected as being inserted is accumulated (402). In gaming machine 100, computer 116 accumulates the coins detected based on a signal supplied by coin acceptor 102. The coins accepted by coin acceptor 102 are diverted either to coin drop box 104 or coin payout hopper 106. Generally, once coin payout hopper 106 is full, coins are diverted to coin drop box 104. If any coins are ejected or removed from either coin drop box 104 or coin payout hopper 106, the accumulated number of coins detected is adjusted accordingly (402), so that the accumulated number of coins reflects the coins that should be in coin drop box 104 and coin payout hopper 106 collectively. In addition, the accumulated number of coins must be adjusted if there are disbursements or additions due to maintenance of the gaming machine.

The weights of the coin containers are sensed and recorded (406). As discussed above, the weights are preferably sensed periodically and at times of expected change. For this method, the sensing should occur contemporaneously with the introduction of the valid coin into the gaming machine.

The weights of the coin containers are converted into a representative number of coins (408). This simply requires dividing the total weight, minus the weight of the empty containers, by the weight of one coin.

The accumulated number of coins represents the number of coins that should be contained in the internal coin containers. The number of coins, as reflected by the weight of the containers, represents the actual number of coins in the internal coin containers. A comparison of these numbers (410) gives an indication of whether there is fraud or theft (412). In gaming machine 100, computer 116 makes this determination. An alarm is indicated (414) if fraud is detected. Otherwise (416), no alarm is indicated and no action is taken until a valid coin is detected.

As can readily be seen from the above description, the present invention is an improvement over prior art methods and apparatus for detecting fraud. The present invention provides an accurate and instantaneous system to monitor and prevent fraud or theft in gaming machines.

While the invention has been described with respect to preferred embodiments, it should be understood that various modifications can be made to the invention without departing from the spirit of the invention or the scope of the appended claims.

What is claimed is:

1. A gaming machine comprising:

a coin payout hopper;

a hopper sensor operably connected to said coin payout hopper to detect a weight of any contents of said coin payout hopper;

a coin payout sensor for detecting passage of coins ejected from said coin payout hopper for receipt by a player of the gaming machine;

means for recording a total number of coins detected by said coin payout sensor;

means for converting the weight of the contents of said coin payout hopper into a number of coins in said coin payout hopper; and means for comparing the number of coins in said coin payout hopper to the number of coins detected by said coin payout sensor to determine if there is a discrepancy therebetween.

2. The gaming machine of claim 1, wherein said hopper sensor has an accuracy of +/– one coin.

3. The gaming machine of claim 1, wherein said coin payout sensor comprises a mechanical sensor.

4. The gaming machine of claim 1, wherein said coin payout sensor comprises an optical sensor.

5. A gaming machine comprising:

a plurality of coin containers housed within an interior area of the gaming machine;

a switch that detects entry into the interior area of the gaming machine and subsequent exit out of the interior area of the gaming machine;

a plurality of coin container sensors operably connected, respectively, to said plurality of coin containers to detect a weight of any contents of said plurality of coin containers;

means for recording a weight produced by said plurality of coin container sensors in response to detection of entry into the interior area by said switch;

means for recording a weight produced by said plurality of coin container sensors in response to detection of exit of the interior area by said switch;

means for comparing the weight produced by said plurality of coin container sensors in response to detection of entry with the weight produced by said plurality of coin container sensors in response to detection of exit.

6. The gaming machine of claim 5 further comprising:

means for registering an expected net change to the plurality of coin containers.

7. The gaming machine of claim 6 further comprising:

means for comparing the weight produced by said plurality of coin container sensors in response to detection of entry with the weight produced by said plurality of coin container sensors in response to detection of exit and the expected net change to the plurality of coin containers.

8. The gaming machine of claim 5 wherein the plurality of coin containers comprises a coin drop box.

9. The gaming machine of claim 5 wherein the plurality of coin containers comprises a coin payout hopper.

10. The gaming machine of claim 8 wherein the plurality of coin containers comprises a coin payout hopper.

11. A method of detecting fraud or theft in a gaming machine comprising the steps of:

A. sensing a weight of any contents of a coin payout hopper;

B. converting the weight of the contents of the coin payout hopper to a number of coins contained in the coin payout hopper;

C. detecting a number of coins ejected from the coin payout hopper to a player of the gaming machine;

D. comparing the number of coins ejected from the coin payout hopper with the number of coins contained in the coin payout hopper to determine if there is a discrepancy therebetween.

12. A method for detecting theft or fraud in a gaming machine comprising the steps of:

A. detecting entry into the interior area of the gaming machine wherein a coin container is housed;

B. recording a weight of the coin container upon detecting entry to produce an entry weight;

C. detecting exit out of the interior area of the gaming machine;

D. recording a weight of the coin container upon detecting exit to produce an exit weight; and E. comparing the entry weight with the exit weight to produce an actual net change wherein the actual net change reflects whether there was a theft or fraud.

13. The method of claim 12 further comprising the steps of:

F. registering an expected net change to the coin container; and

G. comparing the actual net change with the expected net change to thereby determine whether a theft or fraud has occurred.

14. A method of detecting fraud or theft in a gaming machine comprising the steps of:

A. detecting insertion of a valid coin into the gaming machine;

B. accumulating a total number of valid coins detected by incrementing a value each time insertion of a coin is detected;

C. continuously sensing a weight of a plurality of coin containers housed in the gaming machine;

D. converting the weight of the plurality of coin containers into a number of coins contained in the plurality of coin containers; and E. comparing the number of coins contained in the plurality of coin containers with the total number of valid coins detected to determine if there is a discrepancy therebetween.

15. The method of claim 14 wherein the plurality of coin containers comprises a coin drop box.

16. The method of claim 14 wherein the plurality of coin containers comprises a coin payout hopper.

17. The method of claim 15 wherein the plurality of coin containers comprises a coin payout hopper.

18. The method of claim 16 wherein step (B) further comprises decrementing the value each time a coin is ejected from the coin payout hopper.

19. A gaming machine comprising:

a plurality of coin containers housed in the gaming machine;

means for detecting insertion of a valid coin into the gaming machine;

means for accumulating a total number of coins detected by the detecting means;

means for sensing a weight of the plurality of coin containers;

means for converting the weight of the plurality of coin containers into a number of coins contained in the plurality of coin containers; and means for comparing the number of coins contained in the plurality of coin containers with the total number of coins detected by the detecting means.

20. The gaming machine of claim 19 further comprising:

means for detecting ejection of coins from the plurality of coin containers, wherein the accumulating means decreases the total number of coins detected each time the ejection detecting means detects ejection of a coin.

* * * * *